US008259977B2

(12) United States Patent
Jørgensen et al.

(10) Patent No.: US 8,259,977 B2
(45) Date of Patent: Sep. 4, 2012

(54) CONNECTOR ASSEMBLY COMPRISING A FIRST PART AND A SECOND PART ATTACHABLE TO AND DETACHABLE FROM EACH OTHER

(75) Inventors: Martin Bondo Jørgensen, Væløse (DK); Aart Zeger van Halteren, Hobrede (NL); Søren Falkesgaard Ørts, Copenhagen Ø (DK)

(73) Assignee: Sonion A/Sb, Roskilde (DK)

( * ) Notice: Subject to any disclaimer, the term of this patent is extended or adjusted under 35 U.S.C. 154(b) by 1134 days.

(21) Appl. No.: 11/986,163

(22) Filed: Nov. 20, 2007

(65) Prior Publication Data

US 2008/0124981 A1 May 29, 2008

Related U.S. Application Data

(60) Provisional application No. 60/860,425, filed on Nov. 21, 2006.

(51) Int. Cl.
*H04R 25/00* (2006.01)

(52) U.S. Cl. ..... 381/330; 381/324

(58) Field of Classification Search ..... 381/300, 381/322–324, 330; 455/349; 439/660
See application file for complete search history.

(56) References Cited

U.S. PATENT DOCUMENTS 5,753,870 A 5/1998 Schlaegel et al.

FOREIGN PATENT DOCUMENTS

| | | |
|---|---|---|
| EP | 1 681 904 A1 | 7/2006 |
| GB | 1522549 | 8/1978 |
| WO | WO 97/00593 | 1/1997 |
| WO | WO 03/015463 A2 | 2/2003 |
| WO | WO 2004/025990 | 3/2004 |

OTHER PUBLICATIONS

European Search Report for Application No. EP07121099, Nov. 6, 2008: 6 pages.

*Primary Examiner* — Elvin G Enad
*Assistant Examiner* — Andrew R Millikin
(74) *Attorney, Agent, or Firm* — Nixon Peabody LLP

(57) ABSTRACT

An connector assembly for use in, for example, a hearing aid, the assembly having a first connector and a second connector adapted to be detachably attached and being able to transport both sound and electric signals. The invention also relates to an assembly comprising the connector assembly and having a first part comprising an electrical input and a sound providing receiver as well as both an audio output and an electrical output. The two outputs are connected to a second element, normally for positioning inside an ear canal of a person, the second element having a receiver for receiving the electrical signal from the first elements and providing a corresponding sound which is mixed with the sound output by the second element, the mixed sound being output from the second element. The receiver of the first element may be a woofer, and the receiver of the second element may be a tweeter.

14 Claims, 4 Drawing Sheets

CONNECTOR ASSEMBLY COMPRISING A FIRST PART AND A SECOND PART ATTACHABLE TO AND DETACHABLE FROM EACH OTHER

CROSS-REFERENCE TO RELATED APPLICATIONS

This application claims the benefit of the U.S. Provisional Application 60/860,425, filed on Nov. 21, 2006, entitled "An Assembly Comprising A First Part And A Second Part Attachable To and Detachable From Each Other," which is hereby incorporated by reference in its entirety.

FIELD OF THE INVENTION

The present invention relates to a connector assembly having a first part adapted to receive an electrical input and output both a sound and an electrical signal to a second element which receives the electrical output, generates a sound, receives the sound from the first element and outputs a sound. In particular, the present invention relates to an assembly of this type where the first and second parts are attachable to each other and detachable from each other without requiring soldering operations.

The invention is particularly well-suited for application in a new type of hearing aids, the so-called BTE-RIC/RIE hearing aids because the preferred connector assembly comprises, in addition to a set of mating electrical contacts, an acoustical coupling extending through the plug and socket parts.

BACKGROUND OF THE INVENTION

A BTE-RIC/RIE hearing aid may advantageously comprise a high-frequency receiver positioned in the ear plug and a low-frequency receiver positioned inside the housing or casing of the hearing aid. The position of the high-frequency receiver in the ear plug allows a very short acoustic channel to be formed between the sound outlet of the high-frequency receiver and the user's ear canal and ear drum. The short acoustic channel leads to improved high frequency extension in the processed/amplified sound compared to a conventional BTE design wherein the receiver is positioned inside the hearing aid casing and acoustically connected to the ear plug through a long sound tube.

EP 1 681 904 A1 discloses a number of dual-receiver BTE-RIC/RIE hearing aids.

SUMMARY OF THE INVENTION

An advantage of the present invention is that the detachable design of the socket and plug portions of the unitary electrical acoustical connector system allows disconnection of the high-frequency receiver portion of a BTE-RIC/RIE hearing aid. This is useful for example for instant service/repair purposes as well as replacement at the dispenser's office because there is no need to ship the entire BTE-RIC/RIE hearing aid to the factory. Since the high-frequency receiver of BTE-RIC/RIE hearing aid types is placed close to or inside the ear canal of the hearing aid user during normal operation of the BTE-RIC/RIE hearing aid it is vulnerable to clogging and corrosion by ear wax, sweat and similar harmful agents.

In a first aspect, the invention relates to a connector assembly comprising a first and a second releasably attachable connectors, wherein the first connector comprises a first sound propagating part, a first electrically conducting terminal, an opening into the first sound propagating part, and a first exposed part of the first electrically conducting terminal. The second connector comprises a second sound propagating part, a second electrically conducting terminal, an opening into the second sound propagating part, and a second exposed part of the second electrically conducting terminal. The first and second connectors are alignable to establish an electrical connection between the first and second exposed parts and to establish sound propagation through the openings when the first and second connecting members are attached to each other.

In the present context, an opening into an acoustical channel/passage/guide or other acoustical input and output is an element, such as one or more openings, channels, tubes, slits, membranes, wall parts, or the like, or any combination thereof, through which sound may pass into or out of the first and/or second parts. The input/output may allow gas passage between the interior of the first/second parts or not. Normally an input/output is provided with dimensions allowing passage of not only for DC gas pressure equalization purposes but also sound within a predetermined frequency interval. For audio purposes, sound extends through the audible spectrum in the interval of 20-20,000 Hz, but narrower intervals may be desired or required.

An electrical input or output normally comprises a galvanic connection or a connection of an electrically conductive element from the outside of the first/second element to the interior thereof. Naturally, any number of conductors or conductive paths may be provided subject to dimensional restrictions required by any particular application. The housing may comprise an electrically conductive material, such as steel and may be used as one conductive path.

An exposed part of an electrical conductor will be a part of the conductor at which contact thereto may be provided directly from, for example, an outside of the part or element.

An exposed part of an electrically conducting part may be one or more exposed surfaces of each of one or more electrical conductors of the conducting part.

In one embodiment, the first and second connectors are rotatable, around an axis of rotation, in relation to each other during attachment or detachment. Then, the first and second openings preferably are positioned at or on the axis of rotation. In this situation, the two openings could be concentric, during attachment, in order to facilitate transport/guidance/propagation of sound. Naturally, the two openings could have the same size or different sizes. Also, different shapes could be used, such as circular, oval, square, rectangular or any combination thereof. The two openings could have different shapes or the same shape.

Also, an acoustical and/or electrical seal could be positioned between the first and second connectors. When attached to each other, the acoustical and/or electrical seal encircles the first and second openings. In this situation, the encircling may be in a projection perpendicular to the plane of rotation. In this manner, sound propagated between the first and second connectors is prevented from leaking to the outside of the connectors, or is at least sufficiently attenuated not to disturb the user or any acoustical system in the vicinity. Naturally, the sealing means may be resilient or relatively hard. Materials as rubber, plastic, or silicon may be used.

It may be preferred that the exposed parts of the first and second electrically conducting parts are adapted to engage when the first and second connectors are attached to each other. Thus, not only is electrical connection ensured, the engaging parts may also have the further task of maintaining the attachment.

A second aspect of the invention relates to an assembly of a first part detachably connected to a second part. In this second aspect, the first part has a first electrical input, a first sound provider, a receiver connected to the first electrical input and having a first acoustical output, and an electrical output connected to the first electrical input. In this second aspect, the second part has a second electrical input, an acoustical input, a second sound provider, and a receiver connected to the second electrical input and having a second acoustical output, the acoustical input being acoustically connected to a second acoustical output.

The assembly further comprises an assembly according to the first aspect of the invention, wherein the first sound propagating part is acoustically connected to the first acoustical output, the first electrically conducting part is connected to the electrical output, the second sound propagating part is connected to the acoustical input, and the second electrically conducting part is connected to the second electrical input.

Normal receivers are adapted to receive an electrical signal and output a corresponding audio signal. The correspondence between the electrical signal may be any correspondence. The audio output may be altered in any desired manner by the receiver, such as by filtering lower or higher frequencies in the signal. This would be the situation if a signal comprising frequencies in all of the interval of 20-20,000 Hz was fed into a woofer, which would reproduce the lower frequencies with a relatively high amplitude but only the higher frequencies with a much lower amplitude.

The first connecting member may form part of or be attached (such as permanently) to the first part of the assembly, and the second connecting member may form part of or be attached (such as permanently) to the second part of the assembly.

In one embodiment, the first part further comprises a filtering element adapted to filter an electrical signal received from the first electrical input and for outputting a filtered signal to the electrical output. This is particularly interesting when the receivers of the first and second parts are adapted to output sound of different frequency intervals, such as when one receiver is meant to be a tweeter and the other is meant to be a woofer. In this particular situation, the woofer normally is positioned in the first part and the tweeter in the second part.

Naturally, the receivers may be fed with the same or identical electrical signals. Then, they may output similar sound, but receivers of different types may alternatively output sound with different characteristics even when fed with the same signal. For example, a receiver having a low resonance frequency, such as between 500 Hz and 2000 Hz, will tend to attenuate the higher frequencies of the audible spectrum and a receiver having a high resonance, such as between 2800 Hz and 5000 Hz, vice versa. Thus, an alternative to, or in addition to, the filtering of the electrical signal in order to provide different frequency output of the receivers, receivers having different characteristics, such as different resonance frequencies, may be used, especially if different frequency responses are desired from the two receivers.

A further manner of adapting sound is to tailor acoustic characteristics of a channel or path which the sound must pass before being emitted toward the user. This channel or path may be provided with predimensions adapted for altering the characteristics of the sound. This channel or path may be provided between the first and second parts or at the second part for transmitting the sound from the second part toward the surroundings, such as a person's ear.

As lower frequencies will tend to travel in a sound conductor with a lower attenuation than higher frequencies, the filtering element preferably is adapted to remove lower frequency parts of the electrical signal.

In a preferred embodiment, the second part comprises a housing having the acoustical input and a third acoustical output, the second receiver being positioned, inside the housing, in a manner as to output sound, from the second acoustical output, toward the third acoustical output, the acoustical input being positioned opposite the third acoustical output. Then, a channel or sound passage preferably is provided in the housing in order to propagate the sound from the acoustical input around the second receiver and to the third acoustical output. This is especially interesting when the housing snugly fits the second receiver, at least in a cross section across the path from the acoustical input to the third acoustical output, in other positions than at the channel.

The housing may comprise a sound chamber provided between the second and third acoustical outputs, where sound from the acoustical input may be mixed with the sound from the second acoustical output before exiting the third acoustical output.

A third aspect of the present invention relates to a hearing aid comprising the above assembly, wherein the first part is adapted to be positioned outside an ear canal of a person and the second part is adapted to be positioned at or in the ear canal of the person.

Thus, the first part will be positioned further away from the ear canal than the second part.

Preferably, the first part is enclosed inside a hearing aid housing and, the housing further comprising a microphone and a power supplying element as well as a signal processing element adapted to receive a signal from the sound receiving element and forward an electrical signal to the first electrical input of the first part. Actually, the first part may comprise the elements normally seen in hearing aids, in addition to the electrical output and a possible change in the frequency response thereof (typically being an emphasis on the lower frequencies). Then, the second part may be added, normally handling the higher frequencies of the desired sound.

In the present context, a portable communication device may be a hearing prostheses used by hearing impaired persons. A portable communication device may alternatively comprise In-Ear-Monitors or head-sets used by musicians and mobile phone users.

In a fourth aspect, the invention relates to a detachable speaker module having a proximal portion and a distal portion, the proximal portion comprising a first or a second connector of the connector assembly of the first aspect, the distal portion comprising a housing, a sound input, an electrical input, a speaker positioned in the housing and being connected to the electrical input, where the housing having a first end comprising the sound input and a second end comprising a sound output, the speaker being positioned between the first and second ends, the housing further comprising a sound channel adapted to propagate sound from the sound input to the sound output.

Naturally, this module may comprise an electrical conductor and a sound transporting/guiding/propagating element between the distal and proximal portions in order to allow the distal portion to, for example, be positioned in the ear canal of a person.

In general, the distal portion of this module may have the sound mixing chamber etcetera explained in relation to the above aspects and the preferred embodiments described in relation to the drawing.

In a fifth aspect, the invention relates to a speaker module comprising a housing having a sound input, a sound output, an electrical input, and a speaker positioned in the housing and being connected to the electrical input, where the housing has a first end comprising the sound input and a second end comprising the sound output, the speaker being positioned between the first and second ends so as to output sound through the sound output, the housing further comprising a sound channel adapted to propagate sound from the sound input to the sound output.

Thus, the sound channel or conduit according to this aspect preferably transmits sound around the speaker housing. Especially when the receiver or speaker is of a double-membrane type, such as the Sonion 3300 type subminiature receiver, it may be desired to ensure that the sound is transmitted around two opposing longitudinal sides of the receiver in order to cancel out any vibrations or sound exiting from or exciting the outer parts of the speaker due to the operation of that speaker.

The above summary of the present invention is not intended to represent each embodiment or every aspect of the present invention. The detailed description and Figures will describe many of the embodiments and aspects of the present invention.

Figure 1:
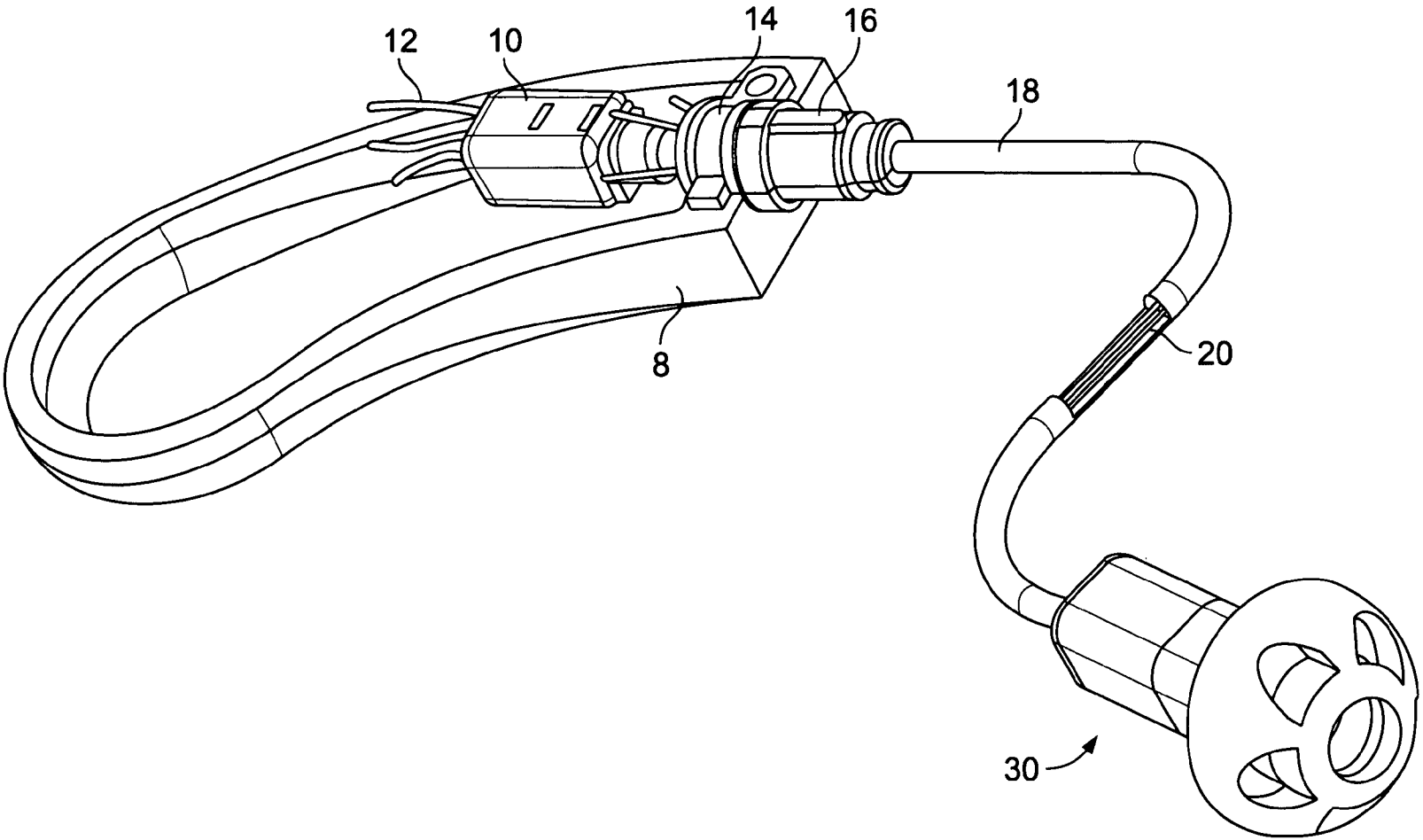
FIG. 1 illustrates a preferred embodiment of a RIC-style hearing instrument comprising a connector according to the invention.
Figure 2:
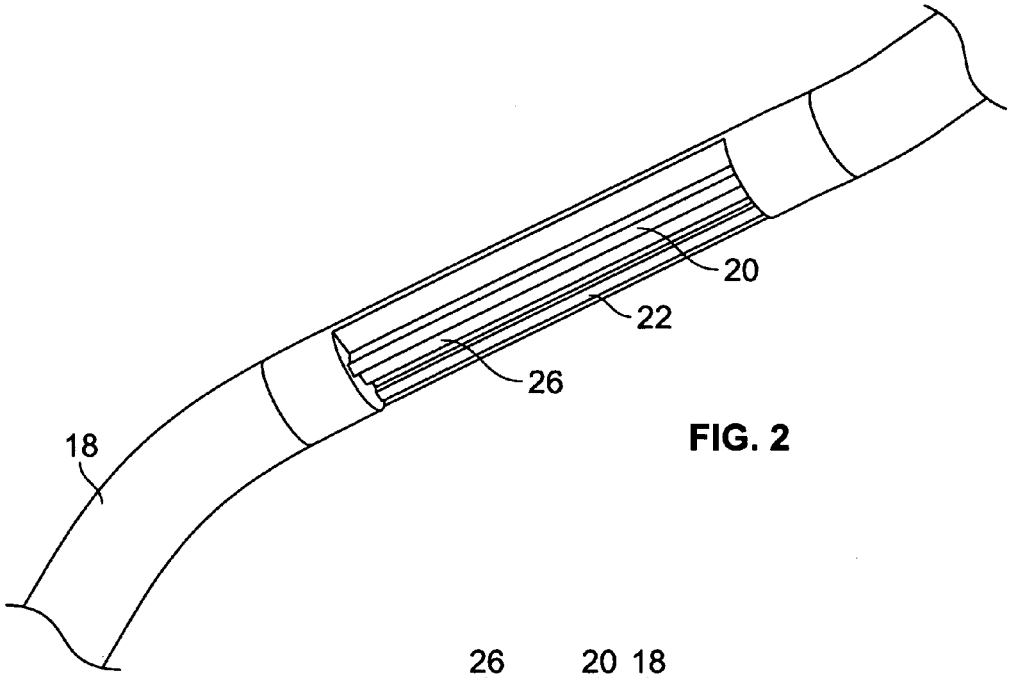
FIG. 2 illustrates a propagating element carrying both electrical and acoustic signals.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DETAILED DESCRIPTION OF INVENTION

In general, FIG. 1 illustrates a hearing aid having two receivers, 10 and 30 adapted to generate low frequency and high frequency sounds, respectively, as desired, in the ear canal of a person.

The high frequency receiver 30 is adapted to be positioned within the ear canal of a person, and the low frequency receiver 10 is positioned outside the persons ear canal, such as in the outer ear or in a hook 8 positioned behind the ear of the person. The sound from the receiver 10 is fed to the receiver 30 along with electrical signals feeding the receiver 30 using a propagating element 18 described further below. Naturally, different lengths of the element 18 may be provided, especially if this element also has a connector (see further below) at the end facing the receiver 30. In this manner, a perfect adaptation of the overall hearing aid may be obtained independently of the shape of the users' ear and independently of the position of the receiver 10 or hook 8.

The receiver 10 comprises an electrical input 12, a receiver (not illustrated), and a sound output 13. The receiver 10 (hereinafter also referred to as "first part 10") or other elements, such as a signal treatment circuit (amplifier, filters or the like) positioned in the part 8 comprises an electrical output (not illustrated) for the receiver 30 (hereinafter also referred to as "second part 30"). The sound output 13 and the electrical output are fed into a connecting member 14, which connects to another connecting member 16 in order to feed both sound and electrical signals from the first part 10 to a transporting/conducting/propagating element 18 (hereinafter "propagating element 18") connected to the connecting member 16 toward a second part 30 to be described further below.

It is seen that the propagating element 18 comprises electrical conductors 20 and 22 provided in a wall thereof, the wall also defining a central opening or channel 26 for conducting sound. Naturally, these conductors may be provided in the propagating element 18 in any suitable manner, such as by being moulded into the propagating element 18 or printed on the channel 26.

Figure 4:
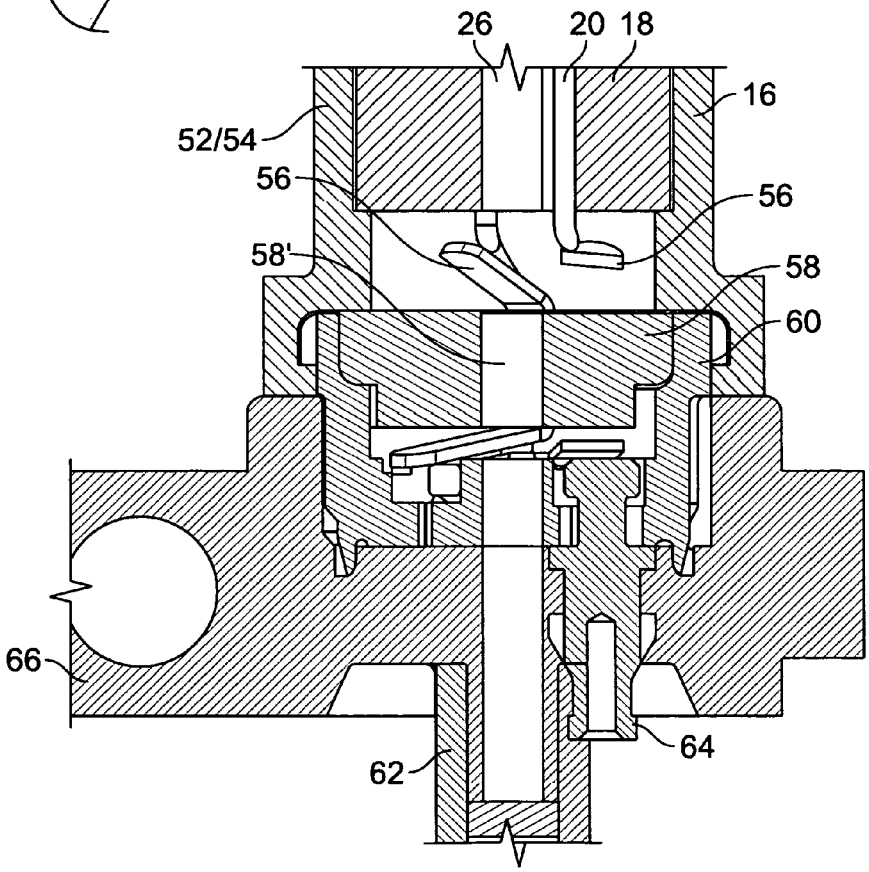
FIG. 4 is a cross section through the connector assembly of FIG. 3.
Figure 3:
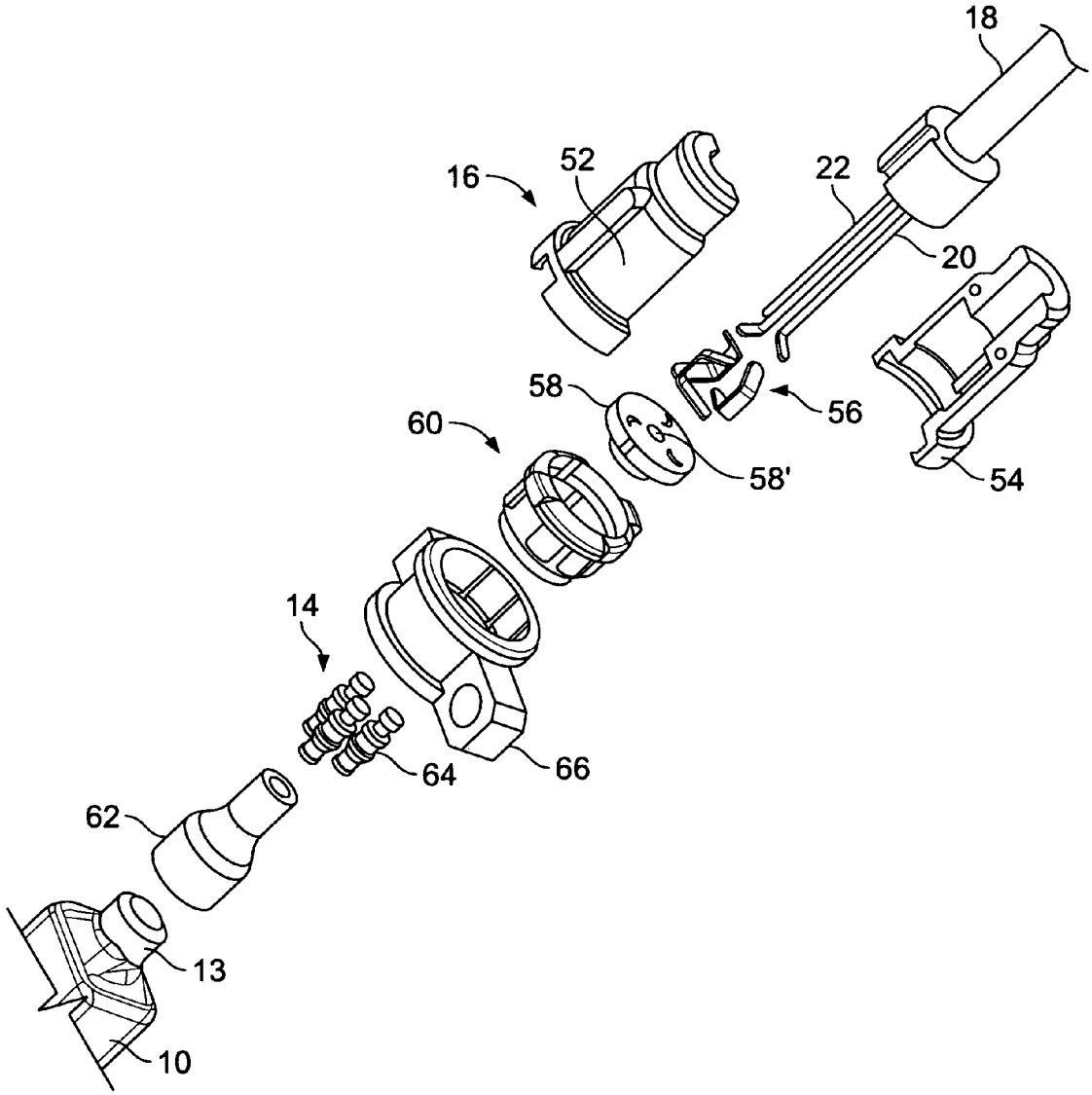
FIG. 3 is an exploded view of the connector assembly of the embodiment of FIG. 1.

In addition, the assembly should be able to be engaged and disengaged in order to facilitate attachment and detachment of a second part 30 (see FIGS. 4 and 5) to/from the first part 10.

It is seen that the end of the propagating element 18 is fixed inside housing parts 52 and 54 of the connecting member 16 so that the conductors 20, 22 each contact a contacting element generally denoted 56, which are fixed inside an element 58 also comprising a central aperture 58' for propagating sound into the channel 26. At the lowest end, the connecting member 16 has a sealing element 60 adapted to acoustically seal around the sound passage in order to avoid or minimize sound leakage from the assembly of the connecting elements 14/16 and create disturbing sound leakage to for example, a hearing aid. This will be described further below.

The connecting member 14 receives the electrical and acoustical signals from the first part 10 via an element 62, which has a central opening for propagating the sound from the receiver of the first part 10 and which is adapted to feed the electrical signals from the first part 10 to contacting pins 64 each adapted to contact a pin 56 during engagement. The element 62 and the pins 64 are fixed inside a housing 66 of the connecting member 14.

The housings 52/54 and 66 are adapted to engage each other in a detachable manner so that the pins 56 and 64 engage and so that the sealing element 60 engages the housing 66 so as to prevent sound from escaping or at least to attenuate such sound.

The engagement of the housings is obtained by rotating the housings in relation to each other. In that manner, the pins 64 are rotated in relation to the pins 56 in a direction so that the contact there between is increased along the rotational direction of attachment. It is seen that the openings/channels 26 and 58' are aligned and positioned centrally in relation to the pins 56/64, whereby the rotation required to obtain attachment is around a rotational axis through the openings/channels 26/58'.

The engagement between the connecting elements 14 and 16 may be any type of engagement, such as a threaded engagement or a bayonet engagement.

Figure 5:
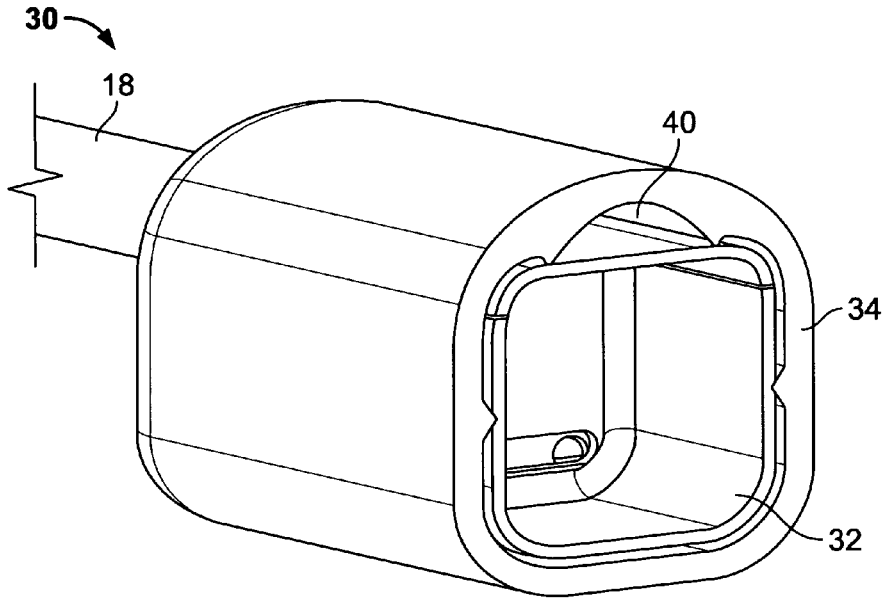
FIG. 5 illustrates a cross section through an exemplary second part for use in an embodiment according to the invention.
Figure 6:
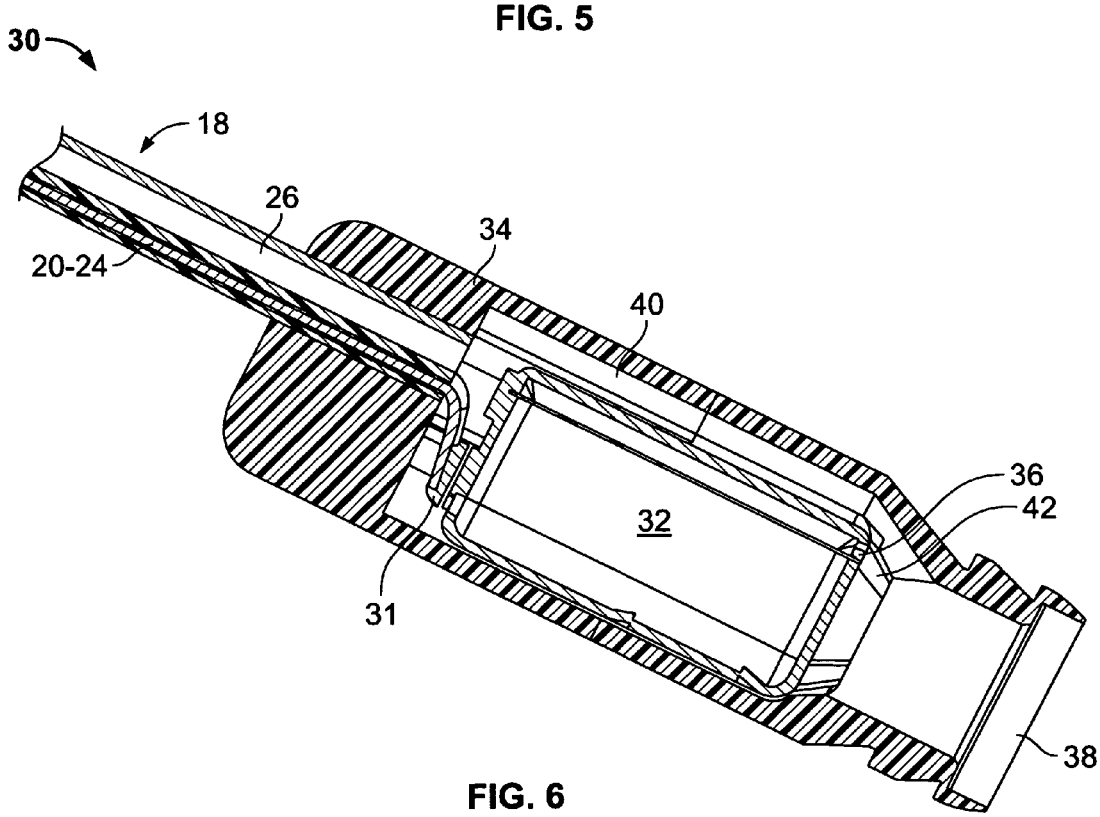
FIG. 6 illustrates another cross section of the second part of FIG. 5.

FIGS. 5 and 6 illustrate different cross sections of the preferred second part 30 adapted to receive the electrical signals propagated over the conductors 20, 22 as well as the sound conducted in channel 26. The propagating element 18 may be seen in the left side of the second part 30, where the conductors 20, 22 are connected to terminals 31 of a receiver 32 provided inside a housing 34 of the part 30.

The receiver 32 has a sound output 36 directed toward a sound output 38 of the housing 34. The channel 26 propagating sound from the first part 10 then has to travel around the receiver 32, and to this effect, a sound conduit or channel 40 is provided inside the housing 34 in which the sound propagates around the receiver 32 and into a mixing chamber 42 receiving sound from the channel 40 and the outlet 36 and from which sound leaves the housing 34 through acoustical output port 38 thereof.

As mentioned above, a preferred manner of using the present embodiment is in a hearing aid designed to provide sound using two receivers, one of which, i.e. the second part, is desired in or at the ear canal of a user and the other being allowed to be positioned further away from the ear canal of the user, such as in a so-called hook to be positioned behind the ear of the user. This hook may then also comprise a microphone, a battery, sound processing elements or signal processing elements for adapting the resulting sound to the requirements of the user.

In another embodiment of the connector system, the sound from the second part may be provided in a separate sound guiding element and fed in parallel with the sound from the second part to a position at which the two audio signals are mixed and output toward the user, such as at an ear plug in the ear canal of the user. In that situation, the second part need not have the housing. In yet another embodiment the audio signals from the first and second parts are merged in a T or Y-shaped coupling before a common sound channel leads sound an outlet of the ear plug.

Naturally, the electrical and audible signals output from the first part toward the second part may be propagated in a number of different means, such as, as is described, a channel-forming element having electrical conductors in wall thereof. However, the electrical conductors may alternatively be provided in a separate chamber of the member, or they may be provided in the sound carrying chamber/channel. A further alternative is to provide separate means for carrying the audible and electrical signals.

Also, any of the receivers of the present assembly may be replaced with a number of receivers in order to, for example, increase the sound quality or sound pressure, if desired.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

The invention claimed is:

1. A connector assembly comprising a first and a second releasably attachable connectors, wherein:

the first connector comprises a first sound propagating part, a first electrically conducting terminal, an opening into the first sound propagating part, and a first exposed part of the first electrically conducting terminal, the second connector comprises a second sound propagating part, a second electrically conducting terminal, an opening into the second sound propagating part, and a second exposed part of the second electrically conducting terminal, the first and second connectors being alignable and releasably connectable with one another to establish an electrical connection between the first and second exposed parts and to establish sound propagation through the openings when the first and second connecting members are releasably attached to each other, wherein the first and second connectors are rotatable, around an axis of rotation, in relation to each other during attachment, along a rotational direction of attachment, the first and second openings being positioned at or on the axis of rotation.

2. An assembly according to claim 1, wherein the first and second connectors are rotatable, around an axis of rotation, in relation to each other during detachment, the first and second openings being positioned at or on the axis of rotation.

3. An assembly according to claim 1, further comprising a sealing means positioned between the first and second connecting members, when attached to each other, the sealing means encircling the first and second openings.

4. An assembly according to claim 1, wherein the first and second exposed parts are adapted to engage when the first and second connectors are attached to each other.

5. An assembly according to claim 1, wherein the first and second exposed parts are arranged to have an increasing contact along the rotational direction of attachment.

6. An assembly of a first part detachably connected to a second part, wherein:

the first part comprises a first electrical input, a first receiver connected to the first electrical input and having a first acoustical output, an electrical output connected to the first electrical input, the second part comprises a second electrical input, an acoustical input, a second receiver connected to the second electrical input and having a second acoustical output, the acoustical input being acoustically connected to the second acoustical output, the assembly further comprises a connector assembly comprising a first and a second releasably attachable connectors, wherein the first connector comprises a first sound propagating part, a first electrically conducting terminal, an opening into the first sound propagating part, and a first exposed part of the first electrically conducting terminal, wherein the second connector comprises a second sound propagating part, a second electrically conducting terminal, an opening into the second sound propagating part, and a second exposed part of the second electrically conducting terminal, and wherein the first and second connectors being alignable and releasably connectable with one another to establish an electrical connection between the first and second exposed parts and to establish sound propagation through the openings when the first and second connecting members are releasably attached to each other, wherein the first sound propagating part is acoustically connected to the first acoustical output, the first electrically conducting part being connected to the electrical output, the second sound propagating part being connected to the acoustical input, and the second electrically conducting part being connected to the second electrical input, and wherein the first and second connectors are rotatable, around an axis of rotation, in relation to each other during attachment, along a rotational direction of attachment, the first and second openings being positioned at or on the axis of rotation.

7. An assembly according to claim 6, wherein the first part further comprises a filtering element adapted to filter an electrical signal received from the first electrical input and for outputting a filtered signal to the electrical output.

8. An assembly according to claim 7, wherein the filtering element is adapted to remove a low frequency portion of the electrical signal such as frequencies below 500 Hz, or 200 Hz or 100 Hz.

9. An assembly according to claim 7, wherein the second part comprises a housing having the acoustical input and a third acoustical output, the second receiver being positioned, inside the housing, in a manner as to output sound, from the second acoustical output, toward the third acoustical output, the acoustical input being positioned oppositely to the third acoustical output.

10. An assembly according to claim 6, wherein the assembly is integrated into a portable communication device, and wherein the first part is adapted to be positioned outside an ear canal of a person and the second part is adapted to be positioned at or in the ear canal of the person.

11. An assembly according to claim 10, wherein the first part is arranged inside a hearing aid housing, the housing further comprising a microphone, a power supplying element as well as a signal processor adapted to receive and process a microphone signal.

12. An assembly according to claim 6, wherein the first and second exposed parts are arranged to have an increasing contact along the rotational direction of attachment.

13. A detachable speaker module comprising:

a proximal portion and a distal portion, wherein the proximal portion comprises a first or a second connector of a connector assembly comprising a first and a second releasably attachable connectors, wherein the first connector comprises a first sound propagating part, a first electrically conducting terminal, an opening into the first sound propagating part, and a first exposed part of the first electrically conducting terminal, wherein the second connector comprises a second sound propagating part, a second electrically conducting terminal, an opening into the second sound propagating part, and a second exposed part of the second electrically conducting terminal, and wherein the first and second connectors being alignable and releasably connectable with one another to establish an electrical connection between the first and second exposed parts and to establish sound propagation through the openings when the first and second connecting members are releasably attached to each other, wherein the distal portion comprises a housing, a sound input, an electrical input, a speaker positioned in the housing and being connected to the electrical input, with the housing having a first end comprising the sound input and a second end comprising a sound output, the speaker being positioned between the first and second ends, and with the housing further comprising a sound channel adapted to propagate sound from the sound input to the sound output, and wherein the first and second connectors are rotatable, around an axis of rotation, in relation to each other during attachment, along a rotational direction of attachment, the first and second openings being positioned at or on the axis of rotation.

14. A speaker module according to claim 13, wherein the first and second exposed parts are arranged to have an increasing contact along the rotational direction of attachment.

* * * * *

UNITED STATES PATENT AND TRADEMARK OFFICE

CERTIFICATE OF CORRECTION

PATENT NO. : 8,259,977 B2
APPLICATION NO. : 11/986163
DATED : September 4, 2012
INVENTOR(S) : Jorgensen et al.

It is certified that error appears in the above-identified patent and that said Letters Patent is hereby corrected as shown below:

On the Title Page, (Item 73) Assignee:
Please delete "Sonion A/Sb" and insert -- Sonion A/S --, therefor.

In column 8, line 63 (claim 9, line 1), please delete "claim 7" and insert -- claim 6 --, therefor.

Signed and Sealed this
Twenty-sixth Day of February, 2013

Teresa Stanek Rea
*Acting Director of the United States Patent and Trademark Office*